US010557189B2

(12) United States Patent
Ota et al.

(10) Patent No.: US 10,557,189 B2
(45) Date of Patent: *Feb. 11, 2020

(54) NI BASED SUPERALLOY, MEMBER OF NI BASED SUPERALLOY, AND METHOD FOR PRODUCING SAME

(71) Applicant: Mitsubishi Hitachi Power Systems, Ltd., Nishi-ku, Yokohama (JP)

(72) Inventors: Atsuo Ota, Yokohama (JP); Shinya Imano, Yokohama (JP); Hironori Kamoshida, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 354 days.

This patent is subject to a terminal disclaimer.

(21) Appl. No.: 14/742,475

(22) Filed: Jun. 17, 2015

(65) Prior Publication Data

US 2015/0368774 A1 Dec. 24, 2015

(30) Foreign Application Priority Data

Jun. 18, 2014 (JP) ..... 2014-125399

(51) Int. Cl.
*C22F 1/10* (2006.01)
*C22C 19/05* (2006.01)
(Continued)

(52) U.S. Cl.
CPC ..... *C22F 1/10* (2013.01); *C22C 19/056* (2013.01); *F01D 5/28* (2013.01); *F23R 3/002* (2013.01)

(58) Field of Classification Search
CPC ..... F01D 13/00; F01D 5/28; C22C 19/056; C22F 1/10
(Continued)

(56) References Cited

U.S. PATENT DOCUMENTS 4,574,015 A 3/1986 Genereux et al.
4,820,353 A 4/1989 Chang
(Continued)

FOREIGN PATENT DOCUMENTS

CN 1053094 A 7/1991
CN 1276022 A 12/2000
(Continued)

OTHER PUBLICATIONS

European Search Report issued in counterpart European Application No. 15172796.3 dated Dec. 3, 2015 (eight pages).
(Continued)

*Primary Examiner* — Jie Yang
(74) *Attorney, Agent, or Firm* — Crowell & Moring LLP

(57) ABSTRACT

To provide a manufacturing process of a Ni based superalloy and a member of the Ni based superalloy which achieves both of excellent workability in a manufacturing step of the Ni based superalloy of the precipitation strengthening type which contains much amount of the gamma prime phase and excellent high temperature strength of the Ni based superalloy. The manufacturing process of a Ni based superalloy includes a step for softening the Ni based superalloy and improving the workability, in which the step for softening the Ni based superalloy and improving the workability is a step for precipitating the gamma prime phase that is incoherent with a gamma phase that is a matrix by 20 vol % or more.

5 Claims, 8 Drawing Sheets

(51) Int. Cl.
*F23R 3/00* (2006.01)
*F01D 5/28* (2006.01)

(58) Field of Classification Search
USPC ..... 148/675
See application file for complete search history.

(56) References Cited

U.S. PATENT DOCUMENTS

| | | | | |
|---|---|---|---|---|
| 5,131,961 | A | 7/1992 | Sato et al. | |
| 5,551,999 | A | 9/1996 | Gostic | |
| 5,605,584 | A | 2/1997 | DeLuca et al. | |
| 5,649,280 | A | 7/1997 | Blankenship et al. | |
| 5,759,305 | A | 6/1998 | Benz et al. | |
| 6,059,904 | A | 5/2000 | Benz et al. | |
| 8,083,124 | B1 | 12/2011 | Darolia et al. | |
| 9,322,089 | B2 * | 4/2016 | Biondo | C22C 19/03 |
| 2004/0221925 | A1 | 11/2004 | Tamaki et al. | |
| 2005/0265887 | A1 | 12/2005 | Toji et al. | |
| 2010/0226814 | A1 | 9/2010 | Uehara et al. | |
| 2010/0278680 | A1 | 11/2010 | Kulkarni et al. | |
| 2011/0058978 | A1 | 3/2011 | Sato et al. | |
| 2011/0181221 | A1 | 7/2011 | Asahi et al. | |
| 2011/0223055 | A1 | 9/2011 | Semba et al. | |
| 2013/0052077 | A1 | 2/2013 | Hardy | |
| 2013/0249581 | A1 | 9/2013 | Miyazono | |
| 2016/0108506 | A1 | 4/2016 | Sato et al. | |
| 2016/0160334 | A1 * | 6/2016 | Imano | C22C 19/007 148/677 |

FOREIGN PATENT DOCUMENTS

| | | | |
|---|---|---|---|
| EP | 0 234 172 | A2 | 9/1987 |
| EP | 0 260 513 | A2 | 3/1988 |
| EP | 0 361 524 | A1 | 4/1990 |
| EP | 0 433 072 | A1 | 6/1991 |
| EP | 0 787 815 | A1 | 8/1997 |
| EP | 2 330 225 | A1 | 6/2011 |
| EP | 2 664 686 | A1 | 11/2013 |
| JP | 63-145737 | A | 6/1988 |
| JP | 2-97634 | A | 4/1990 |
| JP | 8-45751 | A | 2/1996 |
| JP | 9-302450 | A | 11/1997 |
| JP | 2004-332061 | A | 11/2004 |
| JP | 2006-9143 | A | 1/2006 |
| JP | 2011-52308 | A | 3/2011 |
| JP | 2013-52441 | A | 3/2013 |
| JP | 2013-53327 | A | 3/2013 |
| JP | 2013-57122 | A | 3/2013 |
| JP | 2013-68375 | A | 4/2013 |
| JP | 2013-531739 | A | 8/2013 |
| JP | 2013-201390 | A | 10/2013 |
| WO | WO 99/23265 | A1 | 5/1999 |
| WO | WO 2009/028671 | A1 | 3/2009 |
| WO | WO 2010/038826 | A1 | 4/2010 |
| WO | WO 2010/038862 | A1 | 4/2010 |
| WO | WO 2014/157144 | A1 | 10/2014 |
| WO | WO 2015/008343 | A1 | 1/2015 |

OTHER PUBLICATIONS

Japanese Office Action dated Mar. 17, 2015 with partial English translation (seven pages).

Japanese-language Office Action issued in counterpart Japanese Application No. 2016-001409 dated Jan. 30, 2018 with English translation (Six (6) pages).

International Search Report (PCT/ISA/210) issued in PCT Application No. PCT/JP2013/069367 dated Sep. 2, 2013 with English-language translation (Five (5) pages).

Chinese-language Office Action issued in counterpart Chinese Application No. 201380074789.9 dated May 31, 2016 with English translation (Seventeen (17) pages).

Extended European Search Report issued in counterpart European Patent Application No. 13889448.0 dated Jan. 2, 2017 (Eight (8) pages).

* cited by examiner

NI BASED SUPERALLOY, MEMBER OF NI BASED SUPERALLOY, AND METHOD FOR PRODUCING SAME

CLAIM OF PRIORITY

The present application claims priority from Japanese Patent application serial No. 2014-125399, filed on Jun. 18, 2014, the content of which is hereby incorporated by reference into this application.

BACKGROUND OF THE INVENTION

1. Filed of the Invention

The present invention relates to a manufacturing process of a Ni based superalloy, and relates more specifically to a manufacturing process of a Ni based superalloy and a member of the Ni based superalloy, a Ni based superalloy, a member of a Ni based superalloy, a forged billet of a Ni based superalloy, a component of a Ni based superalloy, a structure of a Ni based superalloy, a boiler tube, a combustor liner, a gas turbine blade, and a gas turbine disk achieving both of excellent workability in a manufacturing step of the Ni based superalloy and excellent high temperature strength of the Ni based superalloy.

2. Description of the Related Art

Aiming to improve the efficiency of a gas turbine by raising the combustion temperature, improvement of the heat resistance temperature of gas turbine components has been required. Therefore, with respect to the gas turbine components, as a material excellent in high temperature strength, a Ni based superalloy has been used widely for a turbine disk and blade as well as combustor. The Ni based superalloy achieves excellent high temperature strength by solid solution strengthening effected by adding solid solution strengthening elements such as W, Mo, and Co and precipitation strengthening effected by adding precipitation strengthening elements such as Al, Ti, Nb, and Ta. In the Ni based superalloy of the precipitation strengthening type, the lattice of a γ' (gamma prime) phase ($L1_2$ structure) which is a precipitation strengthening phase precipitates having continuity with a lattice of a γ (gamma) phase (FCC structure, matrix), forms a coherent interface, and thereby contributes to strengthening. Therefore, although the amount of the gamma prime phase just has to be increased in order to improve the high temperature strength, the workability deteriorates as the amount of the gamma prime phase is larger. Accordingly, there are problems that manufacturing of a large forged product becomes harder as the strength of the material becomes higher, and forging cannot be performed due to increase of the defect occurrence rate in forging, and so on.

As a technology for achieving both of the high temperature strength and the hot forgeability of the Ni based superalloy, there is one described in Patent Document 1 (JP-A-2011-052308). In Patent Document 1, a Ni based superalloy is disclosed which contains, in terms of mass, C: 0.001 to 0.1%, Cr: 12 to 23%, Co: 15 to 25%, Al: 3.5 to 5.0%, Mo: 4 to 12%, W: 0.1 to 7.0%, the total of the content of Ti, Ta and Nb is 0.5% or less in terms of mass, and a parameter Ps expressed by an expression (1) ($Ps=-7\times(C\ amount)-0.1\times(Mo\ amount)+0.5\times(Al\ amount)$) is 0.6 to 1.6.

CITATION LIST

Patent Document 1: JP-A-08-45751

Hot forging of a high strength Ni based superalloy whose solvus of the gamma prime phase is 1,050° C. or above is normally performed in the temperature range of 1,000 to 1,250° C. The reason of doing so is to reduce the precipitation amount of the gamma prime phase that is a strengthening factor and to reduce the deformation resistance by raising the working temperature to a temperature around the solvus of the gamma prime phase or thereabove. However, when forging is performed at a temperature around the solvus or thereabove, because the forging temperature comes close to the melting point of a workpiece, working crack is liable to be generated by partial melting and the like. Moreover, when the material whose solvus of the gamma prime phase is high as described above is hot-forged at the solves or above, the gamma prime phase that suppresses grain boundary migration and contributes to refinement of the crystal grain disappears, therefore the grain size of the gamma phase is coarsened, and the tensile strength and the fatigue strength in using the product deteriorate.

In view of the circumstances described above the object of the present invention is to provide a manufacturing process of a Ni based superalloy and a member of a Ni based superalloy which achieves both of excellent workability in a manufacturing step of the Ni based superalloy of the precipitation strengthening type which contains much amount of the gamma prime phase and excellent high temperature strength of the Ni based superalloy.

SUMMARY OF THE INVENTION

The manufacturing process of a Ni based superalloy in relation with an aspect of the present invention includes a step for softening the Ni based superalloy and improving the workability, in which the step for softening the Ni based superalloy and improving the workability is a step for precipitating the gamma prime phase that is incoherent with a gamma phase that is a matrix by 20 vol % or more.

Further, the manufacturing process of a member of a Ni based superalloy in relation with an aspect of the present invention also includes a working step for working a Ni based superalloy obtained by the manufacturing process of a Ni based superalloy described above into a desired shape, and a solution-aging (heat) treatment step for obtaining a Ni based superalloy by performing a solution treatment for solid-dissolving a gamma prime incoherent phase and an aging treatment for re-precipitating a gamma prime coherent phase after the working step.

According to an aspect of the present invention, a Ni based superalloy and a member of a Ni based superalloy can be provided which are capable of significantly improving the workability by containing the gamma prime incoherent phase by 20 vol % or more after the softening treatment step in a high strength Ni based superalloy, and capable of achieving excellent high temperature strength equal to or better than that of a material of a related art in using a product.

Also, by using a Ni based superalloy manufactured using the manufacturing process of a Ni based superalloy or a member of a Ni based superalloy manufactured using the manufacturing process of a member of a Ni based superalloy in relation with an aspect of the present invention, a member of a Ni based superalloy, a component of a Ni based superalloy, and a structure of a Ni based superalloy having various shapes can be manufactured easily.

DETAILED DESCRIPTION OF THE PREFERRED EMBODIMENTS

Hereinafter, an embodiment in relation with the present invention will be explained in detail. However, the present invention is not limited to the embodiment taken up here, and appropriate combinations and modifications are possible within a range not changing the gist.

[Basic Thought of the Present Invention]

The present inventors made intensive studies on the manufacturing process of the Ni based superalloy and the member of a Ni based superalloy capable of achieving the object described above. As a result, it was watched that the gamma prime phase precipitated incoherently with the gamma phase that was the matrix (hereinafter referred to as the gamma prime incoherent phase) did not contribute to strengthening, and it was found out that the workability in forging could be significantly improved by reducing the precipitation amount of the gamma prime phase precipitated coherently with the gamma phase (hereinafter referred to as the gamma prime coherent phase) by increasing the amount of the gamma prime incoherent phase in forging and by achieving the fine duplex phase mainly formed of the gamma phase and the gamma prime incoherent phase simultaneously. Also, it was found out that excellent high temperature strength in using a product could be achieved by performing the solution-aging treatment after working into a desired shape in this state, thereby reducing the gamma prime incoherent phase, and precipitating the gamma prime coherent phase again. The present invention is based on this knowledge.

Figure 6:
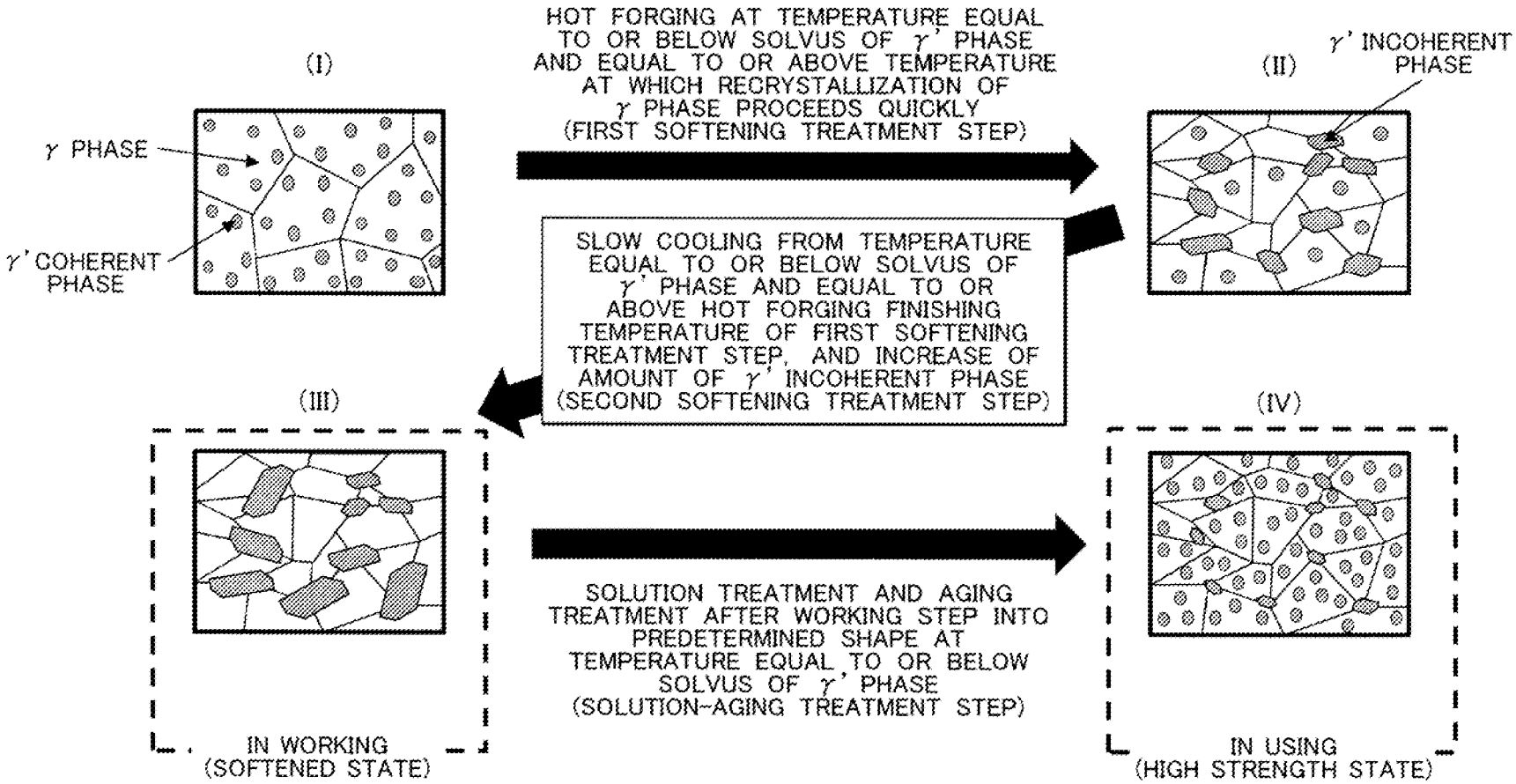
FIG. 6 is a schematic drawing explaining a basic thought of a manufacturing process of a member of a Ni based superalloy in relation with an aspect of the present invention.

Hereinafter, the basic thought of the present invention will be explained in more detail. FIG. 6 is a schematic drawing explaining the basic thought of a manufacturing process of a member of a Ni based superalloy in relation with an aspect of the present invention. In FIG. 6, the manufacturing process of the member of a Ni based superalloy in relation with an aspect of the present invention will be explained observing the microstructure.

As shown in (I) of FIG. 6, the Ni based superalloy after casting step or after forging step contains the gamma phase that is a matrix and the gamma prime coherent phase that precipitates coherently with the gamma phase. This Ni based superalloy is hot-forged at a temperature equal to or below the solvus of the gamma prime phase and equal to or above a temperature at which recrystallization of the gamma phase proceeds quickly, and the gamma prime incoherent phase is precipitated as shown in (II) (the first softening treatment step). Next, the Ni based superalloy is cooled slowly from a temperature equal to or below the solvus of the gamma prime phase and equal to or above the finishing temperature of the hot forging described above, the gamma prime incoherent phase is made to grow, and the amount of the gamma prime incoherent phase is increased as shown in (III) (the second softening treatment step). At this time, because the gamma prime incoherent phase does not contribute to strengthening and the toughness is high because the fine duplex phase mainly formed of the gamma phase and the gamma prime incoherent phase has been formed, a state very easily workable (softened state) has been achieved. In this softened state, the working step for forming the Ni based superalloy into a desired shape is performed at a temperature equal to or below the solvus temperature of the gamma prime phase. After the working step, the gamma prime incoherent phase is solid-dissolved again by performing the solution treatment, the aging treatment is thereafter performed, and the gamma prime coherent phase is thereby precipitated as shown in (IV) (the solution-aging treatment step). At this time, because the gamma prime coherent phase that contributes to strengthening has been precipitated in much amount, a high strength state has been achieved.

As described above, the present invention is to improve the workability not by working in a state the gamma prime phase is reduced or eliminated, but by disabling the strengthening effect of the gamma prime phase. According to the manufacturing steps described above, the Ni based superalloy and the member of a Ni based superalloy can be obtained which can obtain a Ni based superalloy that can soften the material and can significantly improve the workability in working and have the high temperature strength equal to or greater than that of a related art in using (at the time of completion of the product).

Figure 3A:
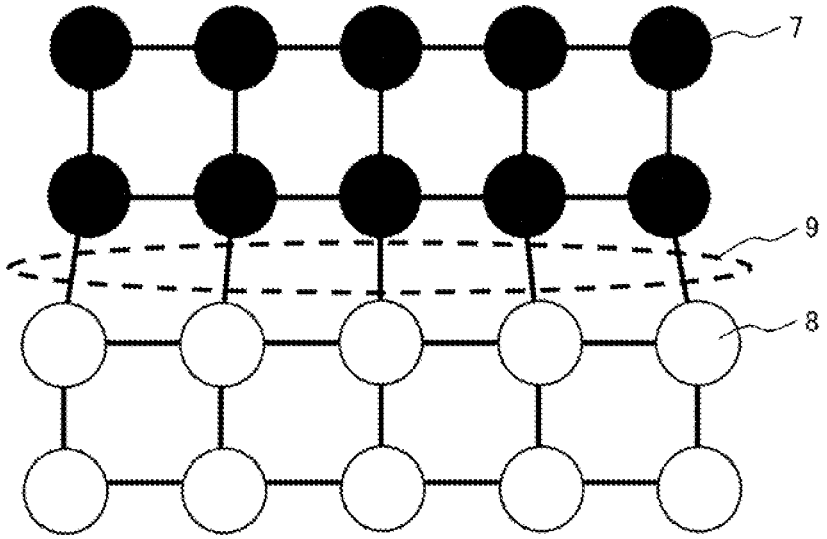
FIG. 3A is a schematic drawing showing a coherent interface of a gamma phase and a gamma prime phase.
Figure 3B:
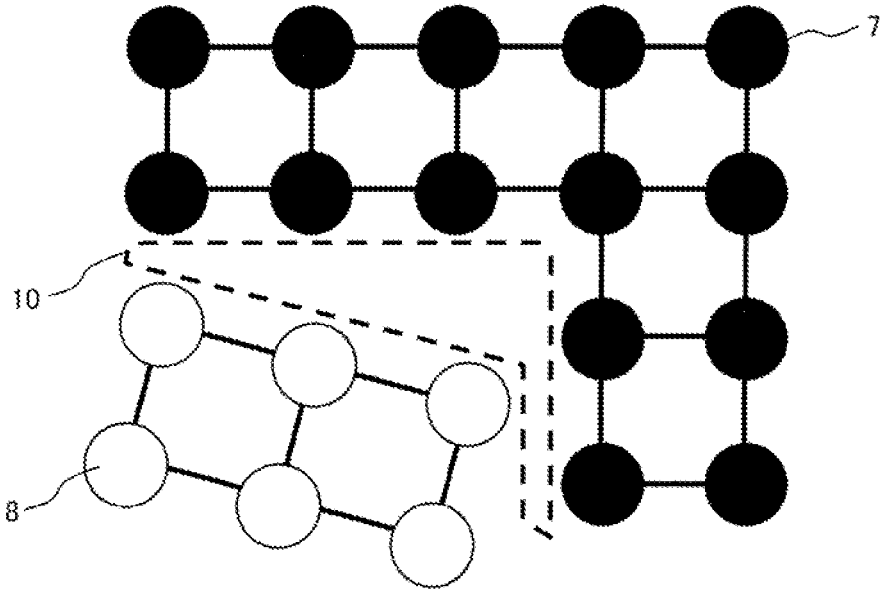
FIG. 3B is a schematic drawing showing an incoherent interface of a gamma phase and a gamma prime phase.

Also, "gamma prime coherent phase" and "gamma prime incoherent phase" in the present invention will be explained. FIG. 3A is a schematic drawing showing a coherent interface of a gamma phase and a gamma prime phase, and FIG. 3B is a schematic drawing showing an incoherent interface of a gamma phase and a gamma prime phase. As shown in FIG. 3A, when atoms 7 forming a gamma phase and atoms 8 forming a gamma prime phase form a coherent interface 9 (lattice coherence), this gamma prime phase is called "gamma prime coherent phase". Also, as shown in FIG. 3B, when the atoms 7 forming a gamma phase and the atoms 8 forming a gamma prime phase form an incoherent interface 10 (lattice incoherence), this gamma prime phase is called "gamma prime incoherent phase".

[Manufacturing Process of Member of Ni Based Superalloy]

Figure 1:
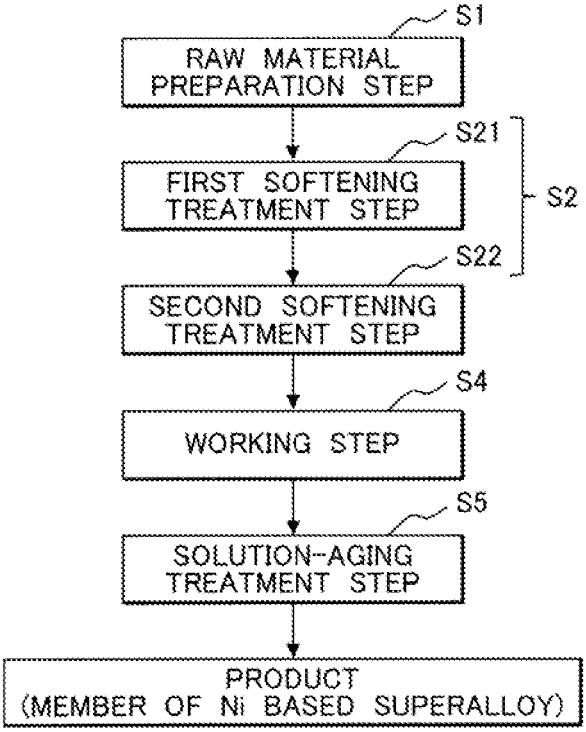
FIG. 1 is a flow diagram showing an embodiment of the manufacturing process of a member of a Ni based superalloy in relation with an aspect of the present invention.

Next, the manufacturing step of a member of a Ni based superalloy in relation with an aspect of the present invention will be explained. FIG. 1 is a flow diagram showing an embodiment of the manufacturing process of a member of a Ni based superalloy in relation with an aspect of the present invention. As shown in FIG. 1, the manufacturing process of a Ni based superalloy in relation with an aspect of the present invention includes a raw material preparation step (S1) for obtaining either of a Ni based casting alloy or a Ni based forging alloy obtained by forging after casting which is a raw material, a softening treatment step (S2) for obtaining a Ni based superalloy softening material by softening treatment of the Ni based superalloy raw material, a working step (S4) for working the Ni based superalloy softening material into a desired shape, and a solution-aging treatment step (S5) for performing a solution treatment and an aging treatment after the working step and obtaining a member of a Ni based superalloy. Also, the softening treatment step (S2) includes a first softening treatment step (S21) and a second softening treatment step (S22). Further, the working step (S4) may include the softening treatment step (S2) and multiple plastic working methods repeatedly before forming into the final shape, and is not to be limited to the final working only.

Also, in the present invention, one obtained by performing the raw material preparation step (S1) is called "Ni based superalloy raw material", one obtained by performing the softening treatment step (S2) is called "Ni based superalloy softening material", and one obtained by performing the solution-aging treatment step (S5) is called "member of a Ni based superalloy". Further, one obtained by performing the solution-aging treatment step (S5) after joining the Ni based superalloy using friction stir welding and the like is called "structure of a Ni based superalloy (joining structure of a Ni based superalloy)". Furthermore, in the present invention, "Ni based superalloy" is to include "Ni based superalloy raw material" and "Ni based superalloy softening material" described above, and is to include one obtained by performing the working step (S4) by once or multiple times with respect to "Ni based superalloy softening material".

Hereinafter, the steps S1 to S5 described above will be explained in detail.

(S1: Raw Material Preparation Step)

With respect to the raw material preparation method of the Ni based superalloy, there is no limitation in particular, and a method of a related art can be used. More specifically, using a ready-made alloy after casting and a ready-made alloy after forging, steps of the softening treatment step described below and onward are performed. Also, as the composition of the Ni based superalloy raw material, one whose solvus of the gamma prime phase is 1,050° C. or above is preferably used. The reason of doing so will be described below in detail.

(S2: Softening Treatment Step)

The manufacturing process of the Ni based superalloy softening material of an aspect of the present invention which improves the workability at the time of the working step includes the first softening treatment step (S21) for hot forging at a temperature equal to or below the solvus of the gamma prime phase, and the second softening treatment step (S22) for slowly cooling the Ni based superalloy after the first softening treatment step from a temperature equal to or below the solvus of the gamma prime phase and equal to or above the hot forging finishing temperature described above and increasing the gamma prime incoherent phase.

(S21: First Softening Treatment Step)

Figure 2:
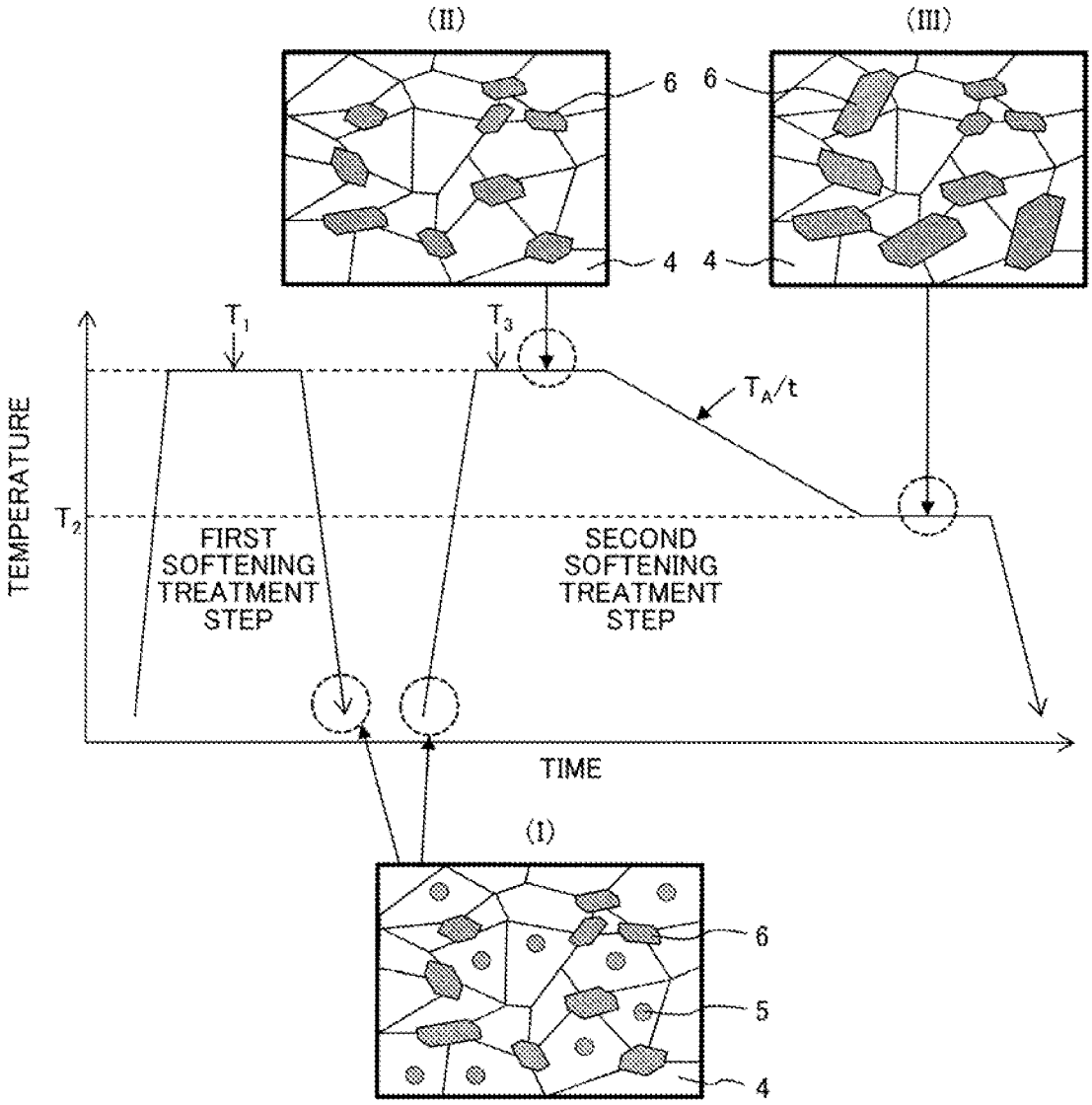
FIG. 2 is a drawing schematically showing a temperature profile and a crystal structure of the softening treatment step of FIG. 1.

FIG. 2 is a drawing schematically showing a temperature profile and a material structure of the softening treatment step of FIG. 1. As described above, in the first softening treatment step, the Ni based superalloy raw material is hot-forged at a temperature ($T_1$) equal to or below the solvus of the gamma prime phase. When slow cooling is performed after this hot forging, as shown in (I) of FIG. 2, a gamma prime incoherent phase (reference sign 6) precipitates on the grain boundary of a gamma phase (reference sign 4). Precipitates shown by the reference sign 5 are the gamma prime coherent phase precipitated within the gamma phase grains during cooling after the first softening treatment step. Also, in the present invention, "on the grain boundary of a gamma phase" means "boundary of neighboring gamma crystal grains".

As described above, the strengthening mechanism of the Ni based superalloy of the precipitation strengthening type contributes to strengthening by that the gamma phase and the gamma prime phase form the coherent interface (reference sign 9 of FIG. 3A), and the incoherent interface (reference sign 10 of FIG. 3B) does not contribute to strengthening. In other words, by increasing the amount of the gamma prime incoherent phase and reducing the amount of the gamma prime coherent phase, it becomes possible to secure excellent workability at the time of the working step. Accordingly, in order to secure the effect of the present invention, it is indispensable that the gamma prime incoherent phase is precipitated by hot forging in the first softening treatment step, and therefore the Ni based superalloy should be capable of effecting the hot forging work at a temperature equal to or below the solvus of the gamma prime phase and equal to or above a temperature at which recrystallization of the gamma phase proceeds quickly. Therefore, the solvus of the gamma prime phase of the Ni based superalloy in relation with an aspect of the present invention is most preferably 1,050° C. or above. Although the effect of the present invention can be secured even when the solvus of the gamma prime phase is 1,000 to 1,050° C., the gamma prime incoherent phase hardly precipitates at 1,000° C. or below, and the effect of the present invention is not secured at 950° C. or below because the gamma prime incoherent phase cannot precipitate. Also, when the solvus of the gamma prime phase comes close to the melting point of the Ni based superalloy raw material, cracks are generated during working due to partial melting and the like, and therefore the solvus of the gamma prime phase is preferable to be below 1,250° C.

As described above, the forging temperature $T_1$ in the first softening treatment step should be equal to or above a temperature at which recrystallization of the gamma phase proceeds quickly. To be more specific, 1,000° C. or above is preferable and 1,050° C. or above is more preferable. When $T_1$ is below 950° C., the gamma prime incoherent phase cannot be precipitated, and the effect of the present invention cannot be secured. Also, the upper limit temperature of $T_1$ is equal to or below the solvus of the gamma prime phase as described above.

(S22: Second Softening Treatment Step)

In the second softening treatment step, by raising the temperature to a temperature ($T_3$) equal to or below the solvus of the gamma prime phase and equal to or above the hot forging finishing temperature in the first softening treatment step described above and solid-dissolving the gamma prime coherent phase precipitated into the gamma phase, a duplex phase structure mainly formed of the gamma phase and the gamma prime incoherent phase is achieved (FIG. 2 (II)), slow cooling is thereafter performed to the temperature $T_2$, and the gamma prime incoherent phase is made to grow, thereby the gamma prime coherent phase precipitated mainly in the cooling process from the temperature of the slow cooling finishing time to the room temperature can be reduced, and therefore the workability can be improved (FIG. 2 (III)). At this time, as the slow cooling rate ($T_A/t$) is slower, the gamma prime incoherent phase can be made to grow more, 50° C./h or less is preferable, and 10° C./h or less is more preferable. When the slow cooling rate is faster than 100° C./h, the gamma prime incoherent phase cannot be made to grow sufficiently, the gamma prime coherent phase precipitates in the cooling process, and the effect of the present invention cannot be secured. Here, the hot forging finishing temperature shows a temperature at which the material to be forged is held at the final stage of forging.

With respect to the slow cooling starting temperature $T_3$ of the second softening treatment step, in order to achieve the duplex phase structure mainly formed of the gamma phase and the gamma prime incoherent phase, it is preferable to start slow cooling at a temperature equal to or below the solvus of the gamma prime phase and equal to or above the hot forging finishing temperature in the first softening treatment step described above. The reason is that the gamma prime coherent phase remains within the gamma phase particles when the slow cooling starting temperature $T_3$ is lower than the forging temperature $T_1$ of the first softening treatment step, and the gamma prime incoherent phase disappears when the slow cooling starting temperature $T_3$ is more than the solvus of the gamma prime phase. However, even when the slow cooling starting temperature $T_3$ is lower by 100° C. than the hot forging finishing temperature in the first softening treatment step described above, the effect of the present invention can be secured.

In the second softening treatment step described above, because the workability can be improved as the gamma prime incoherent phase is increased as described above, the amount of the gamma prime incoherent phase is preferably 20 vol % or more, and is more preferably 30 vol % or more. Here, the rate (vol %) of the content of the gamma prime incoherent phase is the rate (absolute amount) with respect to the entire alloy including the matrix and other precipitates. The amount of the gamma prime incoherent phase for securing the effect of the present invention is to be determined by such relative amount that up to which extent the rate of the gamma prime incoherent phase can be increased relative to the total amount of the gamma prime phase that can be precipitated, and is preferably 50 vol % or more of the total gamma prime phase amount, and is more preferably 60 vol % or more of the total gamma prime phase amount. Also, the temperature ($T_2$) of the slow cooling finishing time described above should be lowered to a temperature at which the gamma prime incoherent phase precipitates by the amount described above, is preferably 1,000° C. or below, and is more preferably 900° C. or below. Further, with respect to the cooling method from the slow cooling finishing temperature $T_2$ to the room temperature, in order to suppress precipitation of the gamma prime coherent phase during cooling, the cooling rate is preferable to be as fast as possible, air cooling is preferable, and water cooling is more preferable.

In order to secure excellent workability, the Vickers hardness (Hv) at the room temperature is preferably 400 or less and more preferably 370 or less, and the 0.2% proof stress at 900° C. is preferably 300 MPa or less, more preferably 250 MPa or less, and most preferably 200 MPa or less.

By performing the second softening treatment step described above, with respect to the Ni based superalloy softening material obtained after the second softening treatment step, one with 400 or less of the Vickers hardness (Hv) at the room temperature and with 300 MPa or less of the value of the 0.2% proof stress at 900° C. can be obtained. By the softening treatment steps described above, the working temperature lower limit that becomes an issue in hot working can be lowered, and it becomes possible to work at a temperature lower than the solvus of the gamma prime phase by 100° C. or more in the working step described below.

Although cooling is performed after the first softening treatment step, and the second softening treatment step is performed in FIG. 2, it is also possible not to perform cooling after the first softening treatment step, and to perform the second softening treatment step.

(S4: Working Step)

With respect to the Ni based superalloy softening material that has become a softened state in the softening treatment step described above, working is performed. There is no limitation in particular with respect to the working method of this time, not only forging work but also other plastic working method and welding or joining method are applicable, and repetitive working can be performed by combination with the softening treatment described above. More specifically, pressing, rolling, drawing, extruding, machining, friction stir welding, and the like are applicable. Also, by combination of the softening treatment step described above and the plastic working method and the like, a member for a thermal power generation plant such as a boiler tube, combustor liner, gas turbine blade and disk using the high strength Ni based superalloy in relation with an aspect of the present invention can be provided. Concrete examples of the member of a Ni based superalloy or the structure of a Ni based superalloy which can be provided by the present invention will be described below in detail.

(S5: Solution-Aging Treatment Step)

Figure 4:
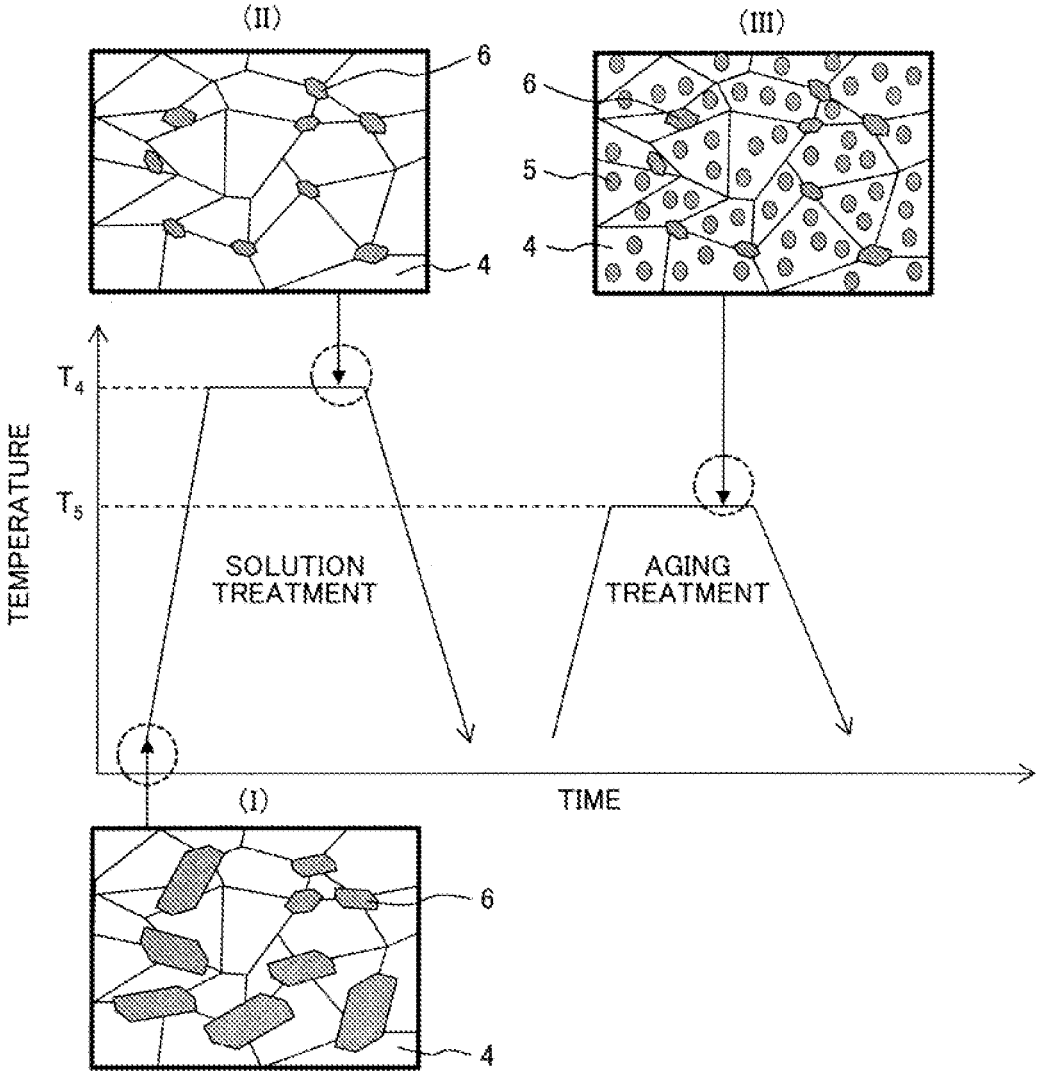
FIG. 4 is a drawing schematically showing a temperature profile and a crystal structure of the solution-aging treatment step of FIG. 1.

FIG. 4 is a drawing schematically showing a temperature profile and a material structure of the solution-aging treatment step of FIG. 1. By performing the solution-aging treatment for solid-dissolving the gamma prime incoherent phase and re-precipitating the gamma prime coherent phase after performing working into a predetermined shape, the high temperature strength can be restored, and it is preferable to precipitate the gamma prime coherent phase by 30 vol % or more at 700° C.

In the present invention, there is no limitation in particular with respect to the condition of the solution treatment and the aging treatment, and the condition generally used can be applied.

(Composition of Ni Based Superalloy Raw Material)

Next, the composition of the Ni based superalloy raw material in relation with an aspect of the present invention will be explained.

It is preferable that the Ni based superalloy raw material in relation with an aspect of the present invention contains, in mass %, 10% or more and 25% or less of Cr, 30% or less of Co, 3% or more and 9% or less of the total of Ti, Nb and Ta, 1% or more and 6% or less of Al, 10% or less of Fe, 10% or less of Mo, 8% or less of W, 0.03% or less of B, 0.1% or less of C, 0.08% or less of Zr, 2.0% or less of Hf, and 5.0% or less of Re, with the balance including Ni and inevitable impurities.

One of more preferable aspects is the Ni based superalloy raw material containing, in mass %, 12.5% or more and 14.5% or less of Cr, 24% or more and 26% or less of Co, 5.5% or more and 7% or less of Ti, 1.5% or more and 3% or less of Al, 3.5% or less of Mo, 2% or less of W, 0.03% or less of B, 0.1% or less of C, and 0.08% or less of Zr, with the balance including Ni and inevitable impurities.

Also, one of other more preferable aspects is the Ni based superalloy containing, in mass %, 15% or more and 17% or less of Cr, 14% or more and 16% or less of Co, 4% or more and 6% or less of Ti, 1.5% or more and 3.5% or less of Al, 0.5% or less of Fe, 4% or less of Mo, 2% or less of W, 0.03% or less of B, 0.1% or less of C, and 0.08% or less of Zr, with the balance including Ni and inevitable impurities.

Also, one of other more preferable aspects is the Ni based superalloy raw material containing, in mass %, 15% or more and 17% or less of Cr, 7.5% or more and 9.5% or less of Co, 2.5% or more and 4.5% or less of Ti, 0.5% or more and 2.5% or less of the total of Nb and Ta, 1.5% or more and 3.5% or less of Al, 3% or more and 5% or less of Fe, 4% or less of Mo, 4% or less of W, 0.03% or less of B, 0.1% or less of C, and 0.08% or less of Zr, with the balance including Ni and inevitable impurities.

Hereinafter, the reason of the amount ratio and selection of the adding element will be shown.

Cr is an element improving oxidation resistance and high temperature corrosion resistance. In order to apply Cr to a high temperature member, addition at least 10 mass % or more is indispensable. However, because excessive addition thereof promotes formation of a harmful phase, Cr is to be made 25 mass % or less.

Co is a solid solution strengthening element having an effect of strengthening the matrix by addition thereof. Further, Co also has an effect of lowering the solvus of the gamma prime phase, and improves high temperature ductility. Co is to be made 30 mass % or less because excessive addition thereof promotes formation of a harmful phase.

Al is an indispensable element forming the gamma prime phase that is a precipitation strengthening phase. Further, Al also has an effect of improving oxidation resistance. Although the adding amount is adjusted according to the aimed precipitation amount of the gamma prime phase, excessive addition thereof deteriorates the workability because the solvus of the gamma prime phase is raised. Therefore, Al is to be made 1 mass % or more and 6 mass % or less.

Ti, Nb, and Ta is an important element stabilizing the gamma prime phase similarly to Al. However, excessive addition thereof causes formation of other intermetallic compounds including a harmful phase, and incurs deterioration of the workability by raising the soleus of the gamma prime phase. Therefore, the total of Ti, Nb, and Ta is to be made 3 mass % or more and 9 mass % or less.

Fe can be substituted to an expensive element such as Co and Ni, and reduces the cost of an alloy. However, Fe is to be made 10 mass % or less because excessive addition thereof promotes formation of a harmful phase.

Mo and W are important elements solid-dissolved into the matrix and strengthening the matrix. However, because they are elements having high density, excessive addition thereof causes increase of the density. Further, because the ductility lowers, the workability also deteriorates. Therefore, Mo is to be made 10 mass % or less, and W is to be made 8 mass % or less.

C, B, and Zr are elements effective in strengthening the grain boundary and improving high temperature ductility and creep strength. However, because excessive addition thereof deteriorates the workability, C is to be made 0.1 mass % or less, B is to be made 0.03 mass % or less, and Zr is to be made 0.08 mass % or less.

Hf is an element effective in improving oxidation resistance. However, because excessive addition thereof promotes formation of a harmful phase, Hf is preferably 2.0 mass % or less.

Re is an element solid-dissolved in the matrix and strengthening the matrix. Further, Re also has an effect of improving corrosion resistance. However, excessive addition thereof promotes formation of a harmful phase. Also, because Re is an expensive element, increase of the adding amount thereof involves cost increase of an alloy.

Therefore Re is preferably 5.0 mass % or less.

Embodiments

Embodiments of the Present Invention will be Explained Below.

Embodiment 1

[Evaluation of Hot Workability]

The composition of specimens is shown in Table 1.

TABLE 1

| | Composition of specimen (mass %) | | | | | | | | | | | | |
|---|---|---|---|---|---|---|---|---|---|---|---|---|---|
| No. | Ni | Cr | Co | Mo | W | Ti | Al | C | B | Zr | Nb | Fe | Others |
| Comparative example 1 | Bal. | 4.2 | 12.5 | 1.4 | 6.0 | 0.0 | 5.8 | 0.050 | 0.004 | 0.000 | 0.00 | 0.0 | 7.2Ta 5.4Re 0.15Hf |
| Comparative example 2 | Bal. | 5.0 | 10.0 | 2.0 | 6.0 | 0.0 | 5.6 | 0.000 | 0.000 | 0.000 | 0.00 | 0.0 | 9Ta 3Re |
| Comparative example 3 | Bal. | 13.3 | 25.1 | 2.7 | 1.3 | 6.0 | 2.5 | 0.014 | 0.010 | 0.033 | 0.00 | 0.0 | |
| Comparative example 4 | Bal. | 13.0 | 25.0 | 2.8 | 1.2 | 5.9 | 2.5 | 0.015 | 0.010 | 0.035 | 0.00 | 0.0 | |

TABLE 1-continued

| Composition of specimen (mass %) | | | | | | | | | | | | | |
|---|---|---|---|---|---|---|---|---|---|---|---|---|---|
| No. | Ni | Cr | Co | Mo | W | Ti | Al | C | B | Zr | Nb | Fe | Others |
| Comparative example 5 | Bal. | 15.9 | 8.2 | 2.8 | 2.6 | 3.4 | 2.5 | 0.015 | 0.012 | 0.035 | 1.10 | 3.8 | |
| Comparative example 6 | Bal. | 15.6 | 8.3 | 2.9 | 2.7 | 3.4 | 2.5 | 0.013 | 0.010 | 0.034 | 1.11 | 3.9 | |
| Comparative example 7 | Bal. | 19.5 | 13.5 | 4.2 | 0 | 2.9 | 1.2 | 0.08 | 0.006 | 0 | 0 | 0 | |
| Comparative example 8 | Bal. | 15.5 | 8.4 | 3.1 | 2.8 | 3.2 | 2.1 | 0.02 | 0.01 | 0.035 | 1.14 | 3.8 | |
| Example 1 | Bal. | 13.6 | 25.2 | 2.8 | 1.2 | 6.0 | 2.4 | 0.015 | 0.010 | 0.034 | 0.00 | 0.0 | |
| Example 2 | Bal. | 14 | 24.8 | 3 | 1.5 | 5.8 | 2.3 | 0.010 | 0.010 | 0.030 | 0.00 | 0.0 | |
| Example 3 | Bal. | 13.8 | 25 | 2.7 | 1.3 | 5.9 | 2.6 | 0.013 | 0.009 | 0.030 | 0.00 | 0.0 | |
| Example 4 | Bal. | 13.5 | 25.3 | 2.8 | 1.5 | 6.0 | 2.5 | 0.015 | 0.010 | 0.033 | 0.00 | 0.0 | |
| Example 5 | Bal. | 16.2 | 14.5 | 2.8 | 1.2 | 5.1 | 2.6 | 0.015 | 0.014 | 0.000 | 0.00 | 0.1 | |
| Example 6 | Bal. | 16.0 | 15.0 | 3.0 | 1.5 | 5.3 | 2.5 | 0.010 | 0.015 | 0.000 | 0.00 | 0.15 | |
| Example 7 | Bal. | 15.7 | 8.4 | 3.1 | 2.7 | 3.4 | 2.3 | 0.020 | 0.011 | 0.034 | 1.12 | 4.0 | |
| Example 8 | Bal. | 15.0 | 8.0 | 3.3 | 2.5 | 3.3 | 2.4 | 0.010 | 0.010 | 0.036 | 1.10 | 3.8 | |
| Example 9 | Bal. | 19.0 | 12.5 | 6.2 | 1.2 | 3.0 | 2.0 | 0.05 | 0 | 0 | 0 | 0 | |

With respect to the Ni based superalloy raw material having the composition shown in Table 1, specimens were manufactured under different manufacturing conditions, and evaluation of the workability and evaluation of high temperature strength were performed with respect to each specimen. In manufacturing each specimen, 10 kg each was molten by a vacuum induction heating melting method, was subjected to homogenizing treatment, and was hot-forged thereafter at 1,150 to 1,250° C., and thereby a round bar with 15 mm diameter was manufactured and was subjected to the first softening treatment step and the second softening treatment step described above. The condition of the first softening treatment step is shown in Table 2. Also, the solvus of the gamma prime phase and presence/absence of the gamma prime phase after the first softening treatment step were evaluated. The solvus of the gamma prime phase was calculated by a simulation based on thermodynamics calculation. Also, presence/absence of the gamma prime phase was evaluated by observation of the microstructure using an electron microscope with respect to the specimens. The result is also shown in Table 2.

TABLE 2

| Property of specimen, condition of first softening treatment step, and evaluation result of material structure after first softening treatment step | | | | |
|---|---|---|---|---|
| No. | Solvus of gamma prime phase [° C.] | Temperature $T_1$ of first softening treatment step (hot forging temperature) [° C.] | Presence/absence of gamma prime phase after first softening treatment step | Remarks |
| Comparative example 1 | 1317 | — | — | Large cracks were generated at the time of hot forging in manufacturing a specimen with 15 mm diameter, Precipitation of a gamma prime incoherent phase was confirmed |
| Comparative example 2 | 1336 | — | — | Large cracks were generated at the time of hot forging in manufacturing a specimen with 15 mm diameter, Precipitation of a gamma prime incoherent phase was confirmed |
| Comparative example 3 | 1203 | Not performed | Yes | |
| Comparative example 4 | 1199 | 1250 | No | |
| Comparative example 5 | 1110 | 1130 | Yes | |
| Comparative example 6 | 1111 | 1100 | Yes | |
| Comparative example 7 | 998 | 950 | No | |
| Comparative example 8 | 1085 | 1050 | Yes | |
| Example 1 | 1192 | 1100 | Yes | |
| Example 2 | 1183 | 1100 | Yes | |
| Example 3 | 1203 | 1100 | Yes | |
| Example 4 | 1203 | 1100 | Yes | |
| Example 5 | 1163 | 1100 | Yes | |
| Example 6 | 1168 | 1100 | Yes | |
| Example 7 | 1102 | 1070 | Yes | |
| Example 8 | 1101 | 1070 | Yes | |
| Example 9 | 1066 | 1020 | Yes | |

In Table 2, with respect to the temperature T1 (hot forging temperature) of the first softening treatment step, when large cracks were generated in hot forging in manufacturing the specimen described above, the softening treatment step of the later stage was not performed and "–" was written, when hot forging of the first softening treatment step was not performed, "not performed" was written, and when a crack was not confirmed after hot forging, the temperature in hot forging was written.

As shown in Table 2, in the comparative examples 1 and 2, large cracks were generated at the time of hot forging in manufacturing the specimen. Although the effect of the present invention can be secured because presence of the gamma prime incoherent phase could be confirmed by observation of the structure after hot forging, the solvus of the gamma prime phase is most preferably 1,250° C. or below. The comparative example 3 is of a state immediately after manufacturing the specimen in which hot forging in the first softening treatment step is not performed, however the gamma prime incoherent phase is present because the hot forging temperature at the time of manufacturing the specimen was equal to or below the solvus of the gamma prime phase. Also, in the comparative example 4, because hot forging was performed at a temperature equal to or above the solvus of the gamma prime phase, the gamma prime incoherent phase did not precipitate after completion of forging. In contrast, in the comparative example 5, although hot forging was performed at a temperature equal to or above the solvus of the gamma prime phase, the gamma prime incoherent phase precipitated due to drop of the temperature which occurred during forging. With respect to the comparative examples 6 and 8 and the examples 1 to 9, in all specimens, because hot forging was performed at a temperature equal to or below the solvus of the gamma prime phase, presence of the gamma prime incoherent phase could be confirmed on the grain boundary of the gamma phase after completion of the first softening treatment step. In the comparative example 7, although hot forging was performed at a temperature equal to or below the solvus of the gamma prime phase, because forging was performed at a temperature below a temperature at which recrystallization of the gamma phase proceeded quickly (1,000° C. or above), the gamma prime incoherent phase did not precipitate.

From the results of the above, it was shown that the forging temperature $T_1$ in the first softening treatment step for precipitating the gamma prime incoherent phase was preferable to be equal to or below the solvus of the gamma prime phase and equal to or above a temperature at which recrystallization of the gamma phase proceeded quickly. More specifically, forging at 1,000° C. or above is preferable, and the gamma prime incoherent phase cannot be precipitated at 950° C. or below. Therefore, the solvus of the gamma prime phase should be equal to or above a temperature at which recrystallization proceeds quickly, and 1,050° C. or above is preferable.

Next, the specimen was cooled slowly from the hot forging temperature $T_1$ of the first softening treatment step to the slow cooling finishing temperature $T_2$ at the cooling rate $T_A$ (° C./h) of each, and was thereafter cooled to the room temperature by water quenching. The condition of the second softening treatment step is shown in Table 3. Also, the amount of the gamma prime incoherent phase and the Vickers hardness at the room temperature after cooling were evaluated. With respect to the amount of the gamma prime incoherent phase, the content rate of the gamma prime incoherent phase was determined by observing the microstructure after casting, after hot forging, or after the softening treatment. More specifically, the area ratio of the gamma prime incoherent phase was calculated from the image observed by the electron microscope, and the content rate of the gamma prime incoherent phase was calculated by converting this area ratio to the volume ratio. Also, in order to evaluate hot workability after the softening treatment, each specimen was hot-forged at 950° C., those without a problem were evaluated to be "o", those in which slight cracks were generated were evaluated to be "Δ", and those in which large cracks were generated and forging was hard were evaluated to be "×".

TABLE 3

Condition of second softening treatment step, evaluation of structure and property after second softening treatment step, and hot workability evaluation

| | Condition of second softening treatment step | | | Microstructure and property after second softening treatment step | | | Equilibrium |
|---|---|---|---|---|---|---|---|
| No. | Slow cooling starting temperature $T_3$[° C.] | Slow cooling finishing temperature $T_2$[° C.] | Slow cooling rate $T_A$/t[° C./h] | Amount of gamma prime incoherent phase after softening treatment step [vol %] | Vickers hardness [Hv] | Hot Workability evaluation | precipitation amount of gamma prime coherent phase [vol %] |
| Comparative example 1 | | — | | — | — | — | 69 |
| Comparative example 2 | | — | | — | — | — | 71 |
| Comparative example 3 | | Not performed | | 3 | 440 | X | 50 |
| Comparative example 4 | | Not performed | | 0 | 490 | X | 50 |
| Comparative example 5 | | Not performed | | 4 | 463 | X | 41 |
| Comparative example 6 | | Not performed | | 11 | 450 | Δ | 41 |
| Comparative example 7 | | Not performed | | 0 | 391 | ○ | 22 |
| Comparative example 8 | 1050 | 900 | 150 | 9 | 348 | X | 36 |
| Example 1 | 1100 | 950 | 50 | 35 | 351 | ○ | 50 |
| Example 2 | 1100 | 950 | 10 | 37 | 325 | ○ | 48 |
| Example 3 | 1100 | 850 | 50 | 40 | 370 | ○ | 51 |

TABLE 3-continued

| Condition of second softening treatment step, evaluation of structure and property after second softening treatment step, and hot workability evaluation | | | | | | | |
|---|---|---|---|---|---|---|---|
| | Condition of second softening treatment step | | | Microstructure and property after second softening treatment step | | | Equilibrium |
| No. | Slow cooling starting temperature $T_3$[° C.] | Slow cooling finishing temperature $T_2$[° C.] | Slow cooling rate $T_A$/t[° C./h] | Amount of gamma prime incoherent phase after softening treatment step [vol %] | Vickers hardness [Hv] | Hot Workability evaluation | precipitation amount of gamma prime coherent phase [vol %] |
| Example 4 | 1100 | 850 | 10 | 42 | 340 | ○ | 51 |
| Example 5 | 1100 | 950 | 10 | 34 | 365 | ○ | 47 |
| Example 6 | 1100 | 900 | 10 | 38 | 342 | ○ | 48 |
| Example 7 | 1070 | 970 | 10 | 22 | 320 | ○ | 39 |
| Example 8 | 1070 | 920 | 10 | 27 | 325 | ○ | 39 |
| Example 9 | 1020 | 920 | 10 | 22 | 238 | ○ | 31 |

As shown in Table 3, with respect to the examples 1 to 9, in all of the specimens, the amount of the gamma prime incoherent phase after the softening treatment step exceeded 20 vol %, the hardness satisfied 400 Hv or less, hot forging at 950° C. could be performed without a problem, and therefore improvement of the workability could be confirmed.

In contrast, in all of the comparative examples 3 to 6 in which the amount of the gamma prime incoherent phase was less than 20 vol % and the hardness was higher than 400 Hv, the cracks were confirmed during forging or after forging. In the comparative examples 5 and 6, although the gamma prime incoherent phase was present after the softening treatment step, the amount was not sufficient for suppressing the precipitation amount of the gamma prime coherent phase in forging. In the comparative example 7, although the gamma prime incoherent phase did not precipitate, the hardness was lower than 400 Hv, and hot forging at 950° C. could be performed. However, the comparative example 7 is not the case with the high strength Ni based superalloy that becomes a target of an aspect of the present invention because the solvus of the gamma prime phase is lower than 1050° C., and the equilibrium precipitation amount of the gamma prime coherent phase at 700° C. calculated by a simulation based on thermodynamics calculation (the precipitation amount of the gamma prime coherent phase that is stable in a thermodynamic equilibrium state) is 22 vol %. Therefore, it was confirmed that 20 vol % or more of the amount of the gamma prime incoherent phase after the softening treatment step was necessary in order to sufficiently secure the effect of the present invention.

Also, when the examples 1 and 2 or the examples 3 and 4 are compared to each other, under a condition the equilibrium precipitation amount of the gamma prime coherent phase at 700° C. is of a same degree and the slow cooling temperature range in the second softening treatment step is same, as the cooling rate is slower, the amount of the gamma prime incoherent phase increases and the hardness can be lowered. It is considered that the reason of it is that, because the gamma prime incoherent phase was made to grow more, the amount of the gamma prime coherent phase that precipitated during cooling mainly from the slow cooling finishing temperature to the room temperature could be reduced. In contrast, in the comparative example 8, although the gamma prime incoherent phase was precipitated after the first softening treatment step and the second softening treatment step was performed, the cooling rate was fast, the gamma prime incoherent phase did not grow, and therefore the effect of the present invention could not be secured sufficiently.

From the results of the above, it was shown that the slow cooling rate of the second softening treatment step was preferably slower than 50° C./h, more preferably 10° C./h or less, and the effect of the present invention could not be secured when the slow cooling rate of the second softening treatment step was faster than 100° C./h.

With respect to the examples 1 to 9, the 0.2% proof stress at 900° C. was 250 MPa or less in all of them. As an example, in the example 7, the 0.2% proof stress at 900° C. was 200 MPa, and very excellent hot workability was exhibited.

Therefore, by applying an aspect of the present invention before hot forging of the Ni based superalloy, the forging temperature can be lowered than the forging temperature of a related art by 100° C. or more, and hot forging can be performed easily. Also, in view of the excellent hot forgeability described above, it is needless to mention that the working step for the Ni based superalloy having been subjected to softening treatment in relation with an aspect of the present invention is not limited to hot forging, and that excellent workability is exhibited even in pressing, rolling, drawing, extruding, machining, and the like.

With respect to the examples 1 to 9, all of them showed a microstructure as shown in FIG. 4 (III) in which the gamma prime incoherent phase almost disappeared and the gamma prime coherent phase precipitated much because the solution-aging treatment process was performed after hot forging at 950° C., and 30 vol % or more of the amount of the gamma prime coherent phase at 700° C. was contained. As an example, in the example 7, the tensile strength at 500° C. exhibited 1,518 MPa which was the strength similar to that of the high strength Ni based superalloy of the related art.

From the results of the above, it was shown that, by applying the manufacturing method of the Ni based superalloy in relation with an aspect of the present invention, hot workability of the high strength Ni based superalloy that was hard in working could be significantly improved.

Embodiment 2

The example of the Ni based superalloy manufactured using the manufacturing process of a Ni based superalloy in relation with an aspect of the present invention will be shown below.

Figure 5A:
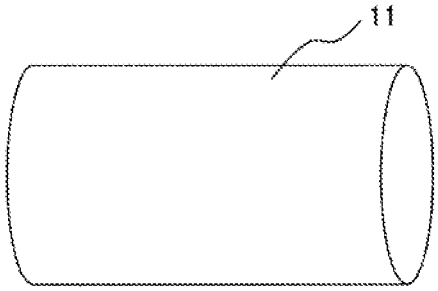
FIG. 5A is a schematic drawing showing an example of a forged billet of a Ni based superalloy manufactured using a manufacturing process of a Ni based superalloy in relation with an aspect of the present invention.

FIG. 5A is a schematic drawing showing an example of a forged billet of a Ni based superalloy manufactured using the manufacturing process of a Ni based superalloy in relation with an aspect of the present invention. This forged billet of a Ni based superalloy is obtained after the softening treatment step S2 described above. According to the related art, in being formed into a structure from a high strength Ni based casting alloy, it was necessary to perform up to the final working in a high temperature range of 1,000 to 1,250° C. in order to reduce the amount of the gamma prime phase that was a strengthening phase and to lower the strength. With a forged billet of a Ni based superalloy 11 manufactured using the manufacturing process of a Ni based superalloy in relation with an aspect of the present invention, very excellent formability can be exhibited in working.

Figure 5B:
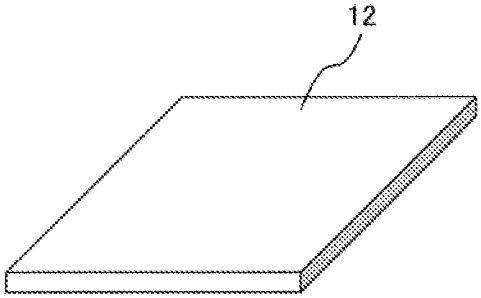
FIG. 5B is a schematic drawing showing an example of a thin sheet made of a Ni based superalloy manufactured by a manufacturing process of a member of a Ni based superalloy in relation with an aspect of the present invention.

By using the forged billet of a Ni based superalloy 11 described above, a thin sheet 12 (with 3 mm or less thickness) using the high strength Ni based superalloy as shown in FIG. 5B can be manufactured by cold rolling or hot rolling.

Figure 5C:
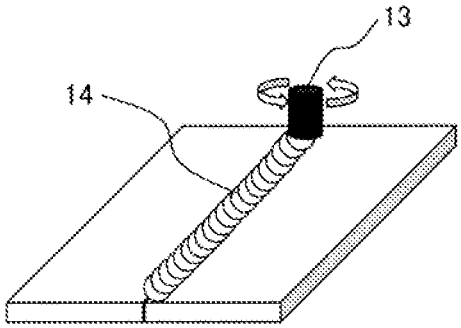
FIG. 5C is a schematic drawing showing an example of a structure of a Ni based superalloy obtained by friction stir welding of a member of a Ni based superalloy manufactured by a manufacturing process of a member of a Ni based superalloy in relation with an aspect of the present invention.

Also, in friction stir welding, because the temperature of a member during working rises to approximately 900° C., the 0.2% proof stress at the working temperature can be made 300 MPa or less by applying an aspect of the present invention, and therefore friction stir welding also becomes possible. Thus, a structure of a Ni based superalloy joined by friction stir welding as shown in FIG. 5C can be obtained.

Figure 5D:
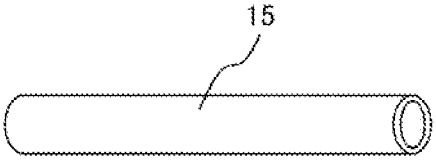
FIG. 5D is a schematic drawing showing an example of a boiler tube featured to use a structure of a Ni based superalloy in relation with an aspect of the present invention.

Also, by using the Ni based superalloy in relation with an aspect of the present invention which has high workability, a boiler tube 15 as shown in FIG. 5D can be easily manufactured.

Figure 5E:
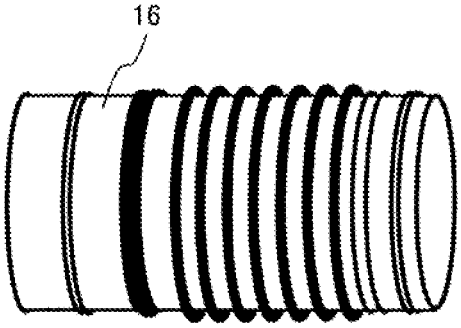
FIG. 5E is a schematic drawing showing an example of a combustor liner featured to use a structure of a Ni based superalloy in relation with an aspect of the present invention.

Further, because bending work of the thin sheet 12 described above is easy, by combination with friction stir welding, a combustor liner 16 as shown in FIG. 5E having more excellent reliability and improving the durable temperature can be manufactured.

Figure 5F:
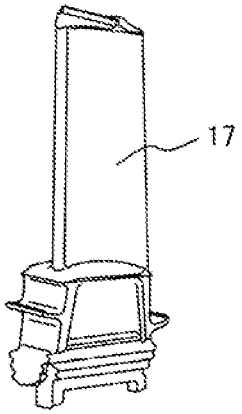
FIG. 5F is a schematic drawing showing an example of a gas turbine blade featured to use a structure of a Ni based superalloy in relation with an aspect of the present invention.

Also, because die forging is easy by using the forged billet of a Ni based superalloy 11 described above, by combination with machining, a gas turbine blade 17 excellent in high temperature strength as shown in FIG. 5F can be manufactured. Further, a high efficiency thermal power generation plant to which these gas turbine members are applied can be achieved.

Figure 5G:
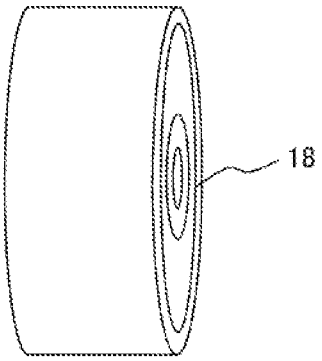
FIG. 5G is a schematic drawing showing an example of a gas turbine disk featured to use a structure of a Ni based superalloy in relation with an aspect of the present invention.

Also, by using the forged billet of a Ni based superalloy 11 described above, a gas turbine disk 18 as shown in FIG. 5G can be easily manufactured.

As explained above, it was proved that, according to the present invention, it was possible to provide a manufacturing process of a Ni based superalloy and a member of a Ni based superalloy which achieved both of excellent workability in a manufacturing step of the Ni based superalloy of the precipitation strengthening type which contained much amount of the gamma prime phase and excellent high temperature strength of the Ni based superalloy. Also, it was proved that, by using the manufacturing process of a Ni based superalloy in relation with an aspect of the present invention, a member of a Ni based superalloy, a component of a Ni based superalloy, and a structure of a Ni based superalloy having various shapes could be easily manufactured.

Further, the embodiments described above were explained specifically in order to assist understanding of the present invention, and the present invention is not limited to those including all configurations explained. For example, a part of a configuration of an embodiment can be replaced by a configuration of another embodiment, and it is also possible to add a configuration of another embodiment to a configuration of an embodiment. Furthermore, with respect to a part of a configuration of each embodiment, it is possible to effect deletion, replacement by another configuration, and addition of another configuration.

REFERENCE SIGNS LIST

4 . . . gamma phase
5 . . . gamma prime coherent phase
6 . . . gamma prime incoherent phase
7 . . . atom composing gamma phase
8 . . . atom composing gamma prime phase
9 . . . coherent interface of gamma phase and gamma prime phase
10 . . . incoherent interface of gamma phase and gamma prime phase
11 . . . forged billet of a Ni based superalloy manufactured using an aspect of the present invention
12 . . . thin sheet manufactured using an aspect of the present invention
13 . . . tool of friction stir welding
14 . . . join part by friction stir welding
15 . . . boiler tube manufactured using an aspect of the present invention
16 . . . combustor liner manufactured using an aspect of the present invention
17 . . . gas turbine blade manufactured using an aspect of the present invention
18 . . . gas turbine disk manufactured using an aspect of the present invention

What is claimed is:

1. A manufacturing process of a Ni based superalloy softening material comprising:

a step for preparing a raw material of a Ni-based superalloy, the raw material of a Ni-based superalloy being subjected to a softening step in a next step;

a step for softening the raw material of the Ni based superalloy and improving workability, the step being performed subsequently to the step for preparing a raw material of a Ni-based superalloy, wherein the step for softening the Ni based superalloy and improving workability is a step for precipitating a gamma prime phase that is incoherent with a gamma phase that is a matrix of the Ni based superalloy by 20 vol % or more, and the step of softening the Ni based superalloy and improving workability comprises:

a first step for hot-forging the Ni based superalloy at a temperature below the solvus of the gamma prime phase; and a second step, being performed subsequently to the first step, for precipitating the gamma prime phase that is incoherent with a gamma phase that is a matrix by 20 vol % or more by slow cooling at equal to or more than 10° C./h and equal to or less than 100° C./h from a temperature below the solvus of the gamma prime phase and increasing the amount of the gamma prime incoherent phase, wherein the solvus of the gamma prime phase is 1,050° C. or above; and further comprising a step of cooling the Ni based superalloy by quenching after the second step.

2. The manufacturing process of a Ni based superalloy softening material according to claim 1, wherein vickers hardness at the room temperature of the Ni based superalloy softening material after the step for softening the Ni based superalloy and improving workability is 400 or less, and 0.2% proof stress at 900° C. is 300 MPa or less.

3. The manufacturing process of a Ni based superalloy softening material according to claim 1, wherein the temperature of starting slow cooling of the second step is a forging temperature of hot forging in the first step and equal to or below the solvus of the gamma prime phase.

4. The manufacturing process of a Ni based superalloy softening material according to claim 1, wherein the composition of the Ni based superalloy contains, in mass %, 10% or more and 25% or less of Cr, 30% or less of Co, 3% or more and 9% or less of the total of Ti, Nb and Ta, 1% or more and 6% or less of Al, 10% or less of Fe, 10% or less of Mo, 8% or less of W, 0.03% or less of B, 0.1% or less of C, 0.08% or less of Zr, 2.0% or less of Hf, and 5.0% or less of Re, with the balance including Ni and inevitable impurities.

5. The manufacturing process of a Ni based superalloy softening material according to claim 1, further comprising a step of cooling the Ni based superalloy to the room temperature by quenching after the second step.

* * * * *